United States Patent [19]

Koboshi et al.

[11] Patent Number: 5,075,202

[45] Date of Patent: Dec. 24, 1991

[54] METHOD OF PROCESSING LIGHT-SENSITIVE SILVER HALIDE COLOR PHOTOGRAPHIC MATERIAL WITH BLEACH-FIXING WITHOUT SUBSTANTIAL WATER WASHING

[75] Inventors: Shigeharu Koboshi; Kazuhiro Kobayashi; Satoru Kuse, all of Hino, Japan

[73] Assignee: Konishiroku Photo Industry Co., Ltd., Tokyo, Japan

[21] Appl. No.: 581,210

[22] Filed: Sep. 10, 1990

Related U.S. Application Data

[63] Continuation of Ser. No. 379,654, Jul. 11, 1989, abandoned, which is a continuation of Ser. No. 142,344, Dec. 28, 1987, abandoned, which is a continuation of Ser. No. 8,141, Jan. 22, 1987, abandoned, which is a continuation of Ser. No. 766,119, Aug. 15, 1985, abandoned.

[30] Foreign Application Priority Data

| | | | |
|---|---|---|---|
| Aug. 20, 1984 | [JP] | Japan | 59-172571 |
| Aug. 20, 1984 | [JP] | Japan | 59-172572 |
| Sep. 14, 1984 | [JP] | Japan | 59-193607 |
| Sep. 14, 1984 | [JP] | Japan | 59-193608 |

[51] Int. Cl.[5] ..... G03C 7/40

[52] U.S. Cl. ..... 430/372; 430/393; 430/428; 430/460; 430/531; 430/950

[58] Field of Search ..... 430/372, 393, 428, 460, 430/523, 531, 532, 533, 538, 588, 950

[56] References Cited

U.S. PATENT DOCUMENTS

| | | | |
|---|---|---|---|
| 3,582,338 | 6/1971 | Yost et al. | 430/532 |
| 3,942,984 | 3/1976 | Heilmann | 430/393 |
| 3,997,348 | 12/1976 | Shimamura et al. | 430/372 |
| 4,384,040 | 5/1983 | Von Meer | 430/532 |
| 4,444,873 | 4/1984 | Ishikawa et al. | 430/393 |
| 4,518,680 | 5/1985 | Koboshi et al. | 430/393 |
| 4,537,856 | 8/1985 | Kurematsu et al. | 430/393 X |
| 4,563,405 | 1/1986 | Ishikawa et al. | 430/393 X |
| 4,780,402 | 10/1988 | Remmington | 430/523 |

FOREIGN PATENT DOCUMENTS 049946 3/1982 Japan .

*Primary Examiner*—Hoa Van Le

*Attorney, Agent, or Firm*—Frishauf, Holtz, Goodman & Woodward

[57] ABSTRACT

A method of processing a light-sensitive silver halide color photographic material which comprises subjecting to imagewise exposure a light-sensitive silver halide color photographic material having a light-sensitive silver halide emulsion layer on i) a substrate coated with a resin cured by irradiation with electron beams or ii) one side or both sides of a substrate of an opaque thermoplastic resin film comprising a synthetic polyester film coated on its one side or both sides with fine particles of white pigment and/or a synthetic polyester film containing said fine particles dispersed in the film and applied with molecular orientation, followed by color developing processing and, after processing by use of processing solution having fixing ability, stabilizing processing without substantially any water washing step. The concentration of silver complex ions in the final stabilizing tank is in the range of $2\times10^{-5}$ to $2\times10^{-1}$ mole/liter. The method is useful for improving particularly the edge stain with lapse of time after the processing.

17 Claims, No Drawings

METHOD OF PROCESSING LIGHT-SENSITIVE SILVER HALIDE COLOR PHOTOGRAPHIC MATERIAL WITH BLEACH-FIXING WITHOUT SUBSTANTIAL WATER WASHING

This application is a Continuation of application Ser. No. 07/379,654, filed July 11, 1989, now abandoned, which is a continuation of Ser. No. 07/142,344 filed Dec. 28, 1987 (abandoned), which is a continuation of Ser. No. 07/008,141 filed Jan. 22, 1987 (abandoned), which is a continuation of Ser. No. 06/766,119 filed Aug. 15, 1985 (abandoned).

BACKGROUND OF THE INVENTION

This invention relates to a method of processing a light-sensitive silver halide color photographic material. More particularly, it relates to a method of processing a light-sensitive silver halide color photographic material which may not cause edge stain of color photographic paper and may improve stability of an image after the processing.

In general, light-sensitive silver halide photographic materials are, after exposure to light, processed by the steps of developing—bleaching—fixing—water washing. Such processing, however, has recently put a problem of environmental preservation or a problem of water resources which has been considered important. For this reason, methods which may reduce the large amount of washing water used have been proposed. For instance, a technique to reduce the amount of washing water by allowing the water to flow backward to washing tanks of multi-stepwise construction, is disclosed in West German Patent No. 29 20 222 as well as in a technical literature of S. R. Goldwasser, "Water flow rate in immersion-washing of motionpicture film" Jour. SMPTE, 64, 248–253, May (1955). Further, a method of carrying out stabilizing processing without substantially any water washing by omitting the washing step is disclosed in Japanese Unexamined Patent Publications No. 8543/1982, No. 14834/1983 and 134636/1983.

On the other hand, polyethylene-coated papers have been used principally as conventional color photographic papers. The polyethylene-coated papers, however, were found to become readily stained during storage because benzyl alcohol or a color developing agent contained in a color developing solution permeates to the papers, to which metal ion in an oxidizing agent or a fixing solution is adsorbed.

In particular, when a non-washing processing is carried out, it was found that, although non-colored directly after the processing, the photographic papers are extremely colored with time lapse during storage because of processing chemicals having not been removed, thereby causing the problem of edge stain. Also, it was found that, when a photographic material having been processed is stored, generation of yellow stains or discoloration of cyan dyes is disadvantageously enormous.

Moreover, since the non-washing processing using the conventional polyethylene-coated photographic paper requires a content of ferric ions in a stabilizing solution, yellow stains are liable to be formed by storing specimens after the processing.

Further, a processing solution may be a bleach-fixing solution which has both the bleaching ability and fixing ability. In a processing solution having the bleaching ability used in the processing of a light-sensitive silver halide color photographic material, inorganic oxidizing agents such as red prussiate and dichromate are widely used as an oxidizing agent to bleach silver images. However, some serious drawbacks have been pointed out in respect of the processing solution having the bleaching ability and containing these inorganic oxidizing agents. For instance, red prussiate and dichromate are relatively excellent in the bleaching power of silver images, but are liable to be decomposed by light to form cyanate ions or hexavalent chromate ions which are harmful to human bodies, and therefore by their nature are undesirable in the prevention of pollution. Also, because of very strong oxidizing powder of these oxidizing agents, it is difficult to make a silver halide solubilizing agent such as thiosulfate (a fixing agent) coexist in a same processing solution, and it is almost impossible to use these oxidizing agents in a bleach-fixing bath, thereby making it difficult to achieve the objects of making the processing speedier and simpler. Moreover, the processing solution containing these inorganic oxidizing agents has a drawback that it is difficult to recycle it without dumping the waste water after processing.

To overcome the above disadvantages, a processing solution employing, as the oxidizing agent, complex metal salts of organic acids such as aminopolycarboxylic acid metal complex salts has recently been used since it may cause less problems of pollution and meet demands for the speedy processing, the simple processing and the recycling of the waste water. However, the processing solution using the metal complex salts of organic acids is slow in the oxidizing action and therefore disadvantageous in that the bleaching rate (oxidizing rate) of silver images (metal silver) formed at a developing step is low. For instance, ethylenediaminetetraacetic acid iron (III) complex salt which is considered strongest in bleaching power among aminocarboxylic acid metal complex salts has been put into practical use in another art, but it is insufficient in the bleaching power when used for high sensitivity light-sensitive silver halide color photographic materials principally comprising silver bromide or silver iodobromide emulsion; in particular, color photographic papers containing silver iodide as silver halide, color photograpic negative films and color reversal films. This results in trace amounts of silver images remaining even after processing for a long period of time making the desilvering property inferior. This tendency is remarkable especially when the bleach-fixing solution is used because the oxidation-reduction potential is lowered in the case of the bleach-fixing solution in which the oxidizing agent is present together with thiosulfate and sulfite.

SUMMARY OF THE INVENTION

An object of this invention is to provide a method of processing a light-sensitive silver halide color photographic material, which can keep dyes stably and may not produce yellow stains or stains on edge, i.e., stains on cut surface of photographic paper, with time lapse during storage even when a non-washing processing is carried out.

Another object of this invention is to provide a method of processing a light-sensitive silver halide color photographic material, which causes less stains at cut surfaces of a photographic paper even when processing is carried out by use of a processing solution employing ferric salt of organic acid, whereby, in particular, the edge stain under time lapse after the processing can be improved to a greater extent.

As a result of intensive studies, the present inventors have found that the above object can be achieved by a processing method as summarized below.

Namely, this invention is to provide a method of processing a light-sensitive silver halide color photographic material which comprises subjecting to imagewise exposure a light-sensitive silver halide color photographic material having a light-sensitive silver halide emulsion layer on i) a substrate coated with a resin cured by irradiation with electron rays or ii) one side or both sides of a substrate of an opaque thermoplastic resin film comprising a synthetic polyester film coated on its one side or both sides with fine particles of white pigment and/or a synthetic polyester film containing said fine particles dispersed in the film and applied with molecular orientation, followed by color developing processing and, after processing by use of a processing solution having fixing ability, stabilizing processing without substantially any water washing step.

The problems mentioned in the foregoing are due to stain generating between a portion coated with polyethylene and an emulsion surface and a problem of detoriorration of image or increase in stain density on white border of prints. Based on such findings, the present inventors have found that the object of this invention can be achieved, as a first aspect of the invention, by subjecting a color printing material having at least one layer of silver halide photographic material on a substrate coated with a resin cured by irradiation with light, to stabilizing processing without any water washing step.

Alternatively, as a second aspect of the invention, the present inventors have found that the object of the invention can be achieved also by subjecting to a stabilizing processing without any water washing step, a light-sensitive silver halide color photographic material having a light-sensitive silver halide emulsion layer on one side or both sides of a substrate of an opaque thermoplastic resin film comprising a synthetic polyester film coated on its one side or both sides with fine particles of white pigment and/or a synthetic polyester film containing said fine particles dispersed in the film and applied with molecular orientation.

As an embodiment of the invention, the above processing solution having fixing solution may be a bleach-fixing solution, in which bleaching and fixing are carried out in a single step. The present inventors have made further studies to have come to a finding that an organic acid ferric complex salt comprising free acid having the molecular weight of 300 or more, which is, among the organic acid metal complex salts, is useful as an oxidizing agent having excellent oxidizing power at a higher pH range. A bleaching solution or a bleach-fixing solution employing such an organic acid ferric complex salt shows a rapid silver bleaching action when it has pH of 3.0 or more, particualrly, 7 or more.

DETAILED DESCRIPTION OF THE INVENTION

This invention will be described below in detail.

As methods in which a coated layer curable by irradiation with electron rays is applied by coating on a paper and then allowing to cure by irradiation with electron rays, which may be used in this invention, there may be mentioned the methods as disclosed in Japanese Unexamined Patent Publications Nos. 27257/1982, 30830/1982, 49946/1982 and 124336/1984, and Japanese Patent Applications Nos. 32237/1984 and 105969/1984.

When by the method mentioned above, it is necessary to apply any adhesion means in order to firmly adhere a photographic image forming layer, that is a hydrophilic colloidal layer comprising a continuous layer of hydrophilic colloids, such as a gelatin silver halide emulsion layer principally comprised of gelatin (hereinafter refered to merely as "photographic layer"), to the substrate having a coated layer.

As a general method of giving the adhesion force between such a photographic layer and the substrate having a coated layer, there may be mentioned a method in which a surface activation processing method known in the art and represented by, for example, corona discharge processing, glow discharge processing or ultraviolet ray irradiation processing is applied on the surface of the substrate, and, after applying this surface activation processing, the photographic layer is directly coated, or a layer or layers comprising a subbing solution having affinity to the above photographic layer is provided on the surface of the substrate to form subbing layer(s) and thereafter the photographic layer is applied on it by coating.

It is also possible to employ a method in which a known compound having ethylenic unsaturated double bonds in the molecule is applied by coating on a base material of a substrate, a cured layer is formed by irradiation with electron rays, and then the photographic layer is coated on the cured layer. In such a case, as a means for adhering the photographic layer to the substrate comprising the cured layer, it is difficult to expect sufficient adhesion force from only the above-mentioned surface activation method by the corona discharge processing or the like, but it can be improved by forming a coated layer of a cured resin obtained by epoxy ring-opening polymerization.

In this invention, the resin cured by irradiation with electron rays includes both a resin cured by initiating a polymerization reaction in the presence of a polymerization initiator while being irradiated with electron rays and a resin cured by initiating the polymerization reaction without the polymerization initiator.

When a polymerization initiator is used, a compound having at least two epoxy groups in one molecule, for example, may be mentioned as a compound capable of initiating the polymerization reaction by the irradiation with electron rays. Namely, the compound having at least two epoxy groups in one molecule (hereinafter referred to as a "epoxy compound of the invention") is a compound in which, when used singularly, the ring-opening polymerization does not occur even by irradiation with electron rays. The polymerization reaction occurs when a substance capable of initiating cation polymerization is co-existent therewith.

The epoxy compound of the invention may includes epoxy resins as mentioned below. However, the epoxy compound of the invention is not limited to these.

Exemplary Compounds

[1] Glycidyl ether type bisphenol A:

-continued (1-1)

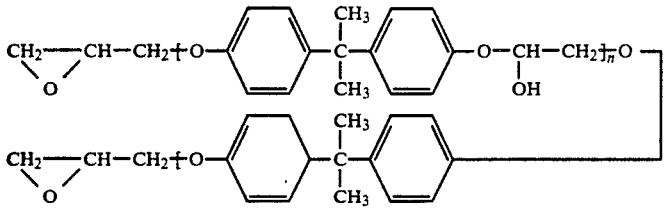

(n = 0 to 10)

[2] Side chain type glycidyl ether type bisphenol A:

(2-1)

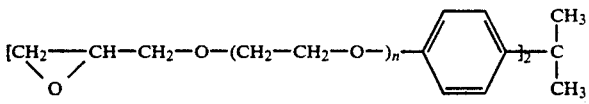

(n = 2 to 3)

[3] Di-(or tri-)glycidyl ether type glycerin:

(3-1)

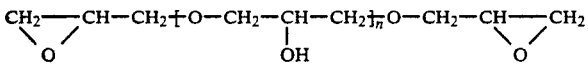

(n = 2)

(3-2)

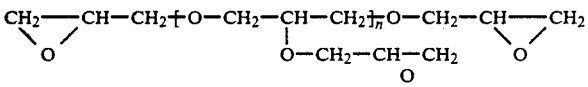

(n = 2)

[4] Alicyclic diglycidylester or alicyclic di-β-methylglycidylester type:
(Compounds having the structure of diglycidyl or di-β-methylglycidylester type containing alicyclic group originated from tetrahydrophthalic acid, hexahydrophthalic acid, etc.)

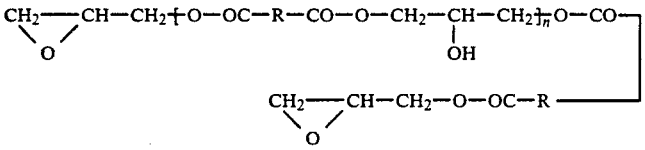

(n = 0 to 1)

(4-1)

(R represents a group of 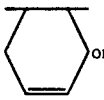 or a group of 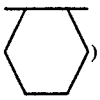 )

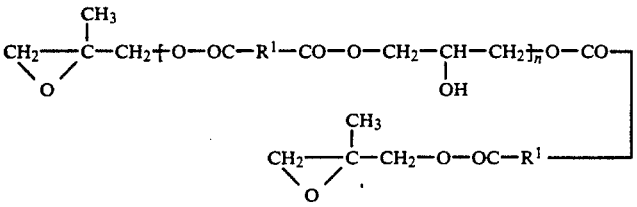

(n = 0 to 1)

(4-2)

($R^1$ represents a group of 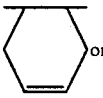 or a group of 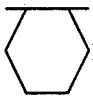 )

[5] Cyclohexaneoxide type:
(Compounds containing one or two cyclohexaneoxide or cyclopentaneoxide group(s) in the molecule)

-continued

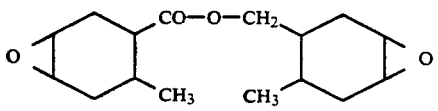

(5-1)

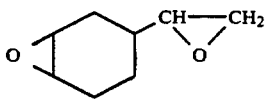

(5-2)

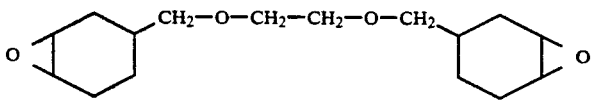

(5-3)

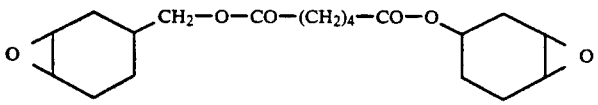

(5-4)

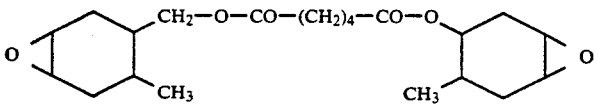

(5-5)

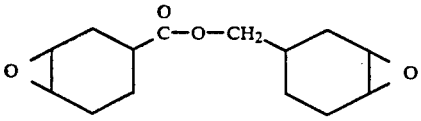

(5-6)

[6] Novolak type epoxy resin:

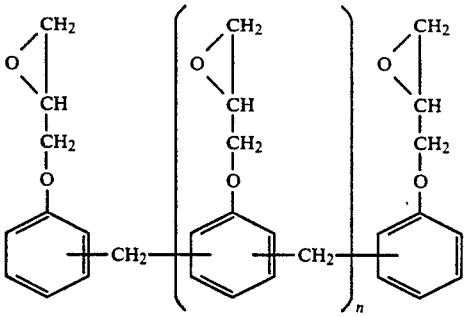

(6-1)

(n = 0 to 2)

The epoxy compounds of the invention as exemplified in the foregoing can be available as commercial products mentioned below:

a) Glycidyl ether type bisphenol A

For example, Epikote 827, 828, 834, 836, 1001, 1004 and 1007, trademarks of Shell Chemical Co.;

Araldite CY 252, CY 250, GY 260, GY 280, 6071, 6084 and 6097, trademarks of Ciba-Geigy Co.; and Epicron 800, 1010, 1000 and 3010, trademarks of Dainippon Ink And Chemical, Incorporated;

b) Side chain type diglycidyl ether type bisphenol A

For example, Adecaresin EP-4000, a trademark of Asahi Denka Kogyo K. K.;

c) Di-(or tri-)glycidyl ether type glycerin

For example, Epikote 812, a trademark of Shell Chemical Co.;

d) Alicyclic diglycidylester or alicyclic di-$\beta$-methyl-glycidylester type

For example, Araldite CY-183 and CY-182, trademarks of Ciba-Geigy Co.;

Epikote E-190 and E-871, trademarks of Shell Chemical Co.;

Shodain S-500, S-508, S-509, S-601X, S-603X, S-607X, S-609X, S-729, S-540 and S-550, trademarks of Showa Denko K. K.; and Epicron 200 and 400, trademarks of Dainippon Ink And Chemicals, incorporated;

e) Cyclohexaneoxide type

For example, ERL-4221, 4289, 4206, 4234 and 4205, trademarks of UCC;

CY-179, CY-178, CY-180 and CY-175, trademarks of Ciba-Geigy Co.; and

CX-221, CX-289, CX-206, CX-301 and CX-313, trademarks of Chisso Corporation;

f) Novolak type epoxy resin

For example, Epikote 152 and 154, trademaks of Shell Chemical Co.;

DEN-431, 438 and 439, trademarks of Dow Chemical Co.;

EPN-1138 and ECN-1235, trademarks of Ciba-Geigy Co.; and

Epicron N-740, N-680, N-695, N-565 and N-577, trademarks of Dainippon Ink And Chemicals, Incorporated.

The epoxy compound of the invention is a compound having the molecular weight ranging preferably from 10,000 or less, more preferably from 100 to 3,000.

There is no particular limitation for the polymerization initiator according to this invention, but preferably an onium salt which discharges Lewis acid capable of initiating the polymerization by irradiation with electron rays may be used. Such an onium salt can be represented by General Formula [I] below.

General Formula [I]

$$[R_a^1R_b^2R_c^3R_d^4Z]^{+m}[MX_{m+n}]^{-m}$$

In the formula, $R^1$, $R^2$, $R^3$ and $R^4$ may be the same or different and each represent an organic group; a, b, c and d each represent an integer of 0 to 3 and the sum of a+b+c+d is equal to the valence of Z.

Z represents a group of N≡N, S, Se, Te, P, As, Sb, Bi, halogen atoms (for example, iodine, chlorine, bromine and the like atoms); and M is a metal or semi-metal which is a central atom of a halide complex, and represents Sb, Fe, Sn, Bi, Al, Ga, In, Ti, Zn, Sc, V, Cr, Mn, Co and the like.

X represents a halogen atom; m represents a net electric charge in halide complex ions; and n represents number of halogen atoms in halide ions.

In General Formula [I] above, the complex ions represented by $[MX_{m+n}]^{-m}$ may include $BF_4^-$, $PF_6^-$, $AsF_6^-$, $SbF_6^-$, $FeCl_4^{2-}$, $SnCl_6^{2-}$, $SbCl_6^{2-}$, $BiCl_5^{2-}$, etc.

Of the compounds represented by the above Formula [I], diazonium compounds do not necessarily have good preservability, have a shorter pot life and to require a two-part liquid combination system. Also, they are liable to produce bubbles or pin holes in a coated layer because of nitrogen gas generated by the decomposition, and sometimes cause coloration of the cured layer. Therefore ,in this invention, it is preferred to use the compounds other than the diazonium compounds for the reasons that they are excellent in the preservability, suitable for the one-part liquid system and free from the concern of generating nitrogen gas.

The the onium series polymerization initiators represented by Formula [I] mentioned above are known in the art. For instance, the compound in which Z is the group of N≡N, namely a diazonium compound, is disclosed in U.S. Pat. Nos. 3,708,296; 3,794,576 and 3,949,143. The other onium series polymerization initiators are disclosed in Belgium Patent Nos. 828,841 and 828,669, French Patent No. 2,270,269, etc.

The above diazonium compounds can be prepared by the method disclosed in the above U.S. Pat. Nos. 3,708,296 and 3,949,143 or the method disclosed in A. L. Mayoock et al, "Organic Chemistry", Vol. 35, No. 8, p 2532 (1970), I. Goerdeler, "Methoden der Organischen Chemie", 11/12, pp 591-640 (1958), K. Sasse, ditto, 12/1, pp 79-112 (1963), M. Drexler et al, J.A.C.S., Vol. 75, p 2705 (1953), etc.

The amount in which the polymerization initiator is used according to this invention may be determined in correspondence with the curing rate and the curing method to be applied. It is preferred to use it in the range of from 0.05 to 10 parts by weight based on 100 parts by weight of the resin component in a layer of "a composition according to this invention" (as defined hereinafter).

When the polymerization initiator is not used, the resin copolymerizable by irradiation with electron rays may include, for example, a compound having double bond(s) in the molecule; preferably a compound having a plurality of double bonds in the molecule; more preferably a compound containing acryloyl group, methacryloyl group, acrylamide group, allyl group, vinyl ether group, vinyl thioether group, etc., and unsaturated polyesters; and most preferably unsaturated polyesters, unsaturated acrylates and unsaturated polycarbonates disclosed in A. Vrancken Fatipec Congress 1119 (1972), having molecular weight of about 1,000 to 20,000.

The light-sensitive material according to the first aspect of this invention may contain an inorganic white pigment. As the white pigment, those which are usually used in the field of photographic papers may be used, and, for example, titanium oxide (of anatase type and rutile type), barium sulfate, calcium carbonate, aluminum oxide, magnesium oxide, etc. can be used, and in particular titanium oxide, barium sulfide and calcium carbonate are preferred.

Also, the titanium oxide may be coated partially on its surface with hydrous metalic oxide compounds, for example, metal oxides of hydrous aluminum oxide, hydrous ferrite oxide, etc. However, any of the inorganic white pigments may be used without any particular limitation.

It is preferred to use the inorganic white pigment in an amount ranging from 20 to 200 parts by weight based on 100 parts by weight of the above compound curable by irradiation with electron rays.

It is also preferred for the pigment to have an average particle size of from 0.1 to 10 μm.

The layer of a composition comprising the resin copolymerizable by irradiation with electron rays, the polymerization initiator optionally used and the inorganic white pigment also optionally used according to this invention (hereinafter referred to as a "composition according to this invention") may be applied by coating on the substrate as a layer constituted singularly or as layers constituted in plurality.

The paper substrate to be used in this invention may include, for example, natural pulp, synthetic pulp and a paper comprising a mixture of these. To these papers, known paper strengthening agent, sizing agent, inorganic pigment, colorant, fluorescent whitening agent and the like may be added optionally.

Besides the above-mentioned, as the substrate according to this invention, a synthetic paper such as polypropylene and polyester, a film base such as polyethylenetelephthalate may be used. Moreover, even a substrate obtained by applying lamination on the surface of a paper to form a composite material may be used.

A coated layer formed by allowing the layer of the composition according to the invention on the substrate to cure by irradiation with electron rays (herein after referred to as "the coated layer according to the invention") may be finished in mirror face by applying a smoothening treatment, or may be applied optionally with embossing.

To perform the mirror face finishing, a treated surface may be brought into contact with a mirror face roll and cured by irradiating electron rays from the back side of the substrate to give a mirror face a finished surface. Alternatively, preliminary irradiation may be carried out to cure the surface in part, and thereafter the treated surface may be brought into contact with a mirror face roll and then peeled, followed by secondary irradiation to have it cured completely.

The mirror face roll includes a chrome-plated roll, a stainless steel roll, etc.

When the embossing is applied, as an embossing roll to be used in place of the mirror face roll, there may be used a roll obtained by embossing silky patterns, fine particulate patterns, etc. on the roll such as stainless steel roll and chrome-plated roll by surface sanding, spattering, etching, plating or the like method.

In order to apply the mirror face finishing or the embossing treatment, it may be applied after coating of a solution of the composition and after removal of a part or all of organic solvents. Alternatively, the removal of the organic solvents may be performed after having applied the embossing.

In this invention, as an electron beam accelerator used for the irradiation with electron rays, there may be employed any of an electrocurtain system, a Van de Graff type scanning system and a double scanning system.

As for electron ray characteristics, it is preferred from a viewpoint of transmission power to use an electron beam accelerator of 100 to 750 kV, preferably 150 to 300 kV, and to control the dosage of absorption to 0.5 to 20 Mrad.

When the irradiation with electron rays is carried out, it may be done in the atmosphere of an inert gas such as $N_2$, He, $CO_2$, etc.

The coated layer according to the invention as such exhibits good adhesiveness to the photographic layer, but it can exhibit more excellent adhesiveness by applying a surface activation treatment such as a treatment by corona discharging or glow discharging. An adhesion effect same as the above-mentioned can also be obtained by simple subbing processing with use of gelatin or the like.

In this invention, at least one coated layer of the coated layers according to the invention is provided on the substrate at the side having a layer on which photographic images are formed (for example, a silver halide emulsion layer, an image receiving layer in the dye diffusion process, etc.).

Further, the coated layer(s) according to the invention is preferably provided on both sides of the substrate from the viewpoint of waterproof. When there is at one side thereof no layer on which photographic images are formed, this kind of coated layer at this side can be a coated layer having the constitution such that the inorganic white pigment is removed from the coated layer according to the invention.

The substrate in this invention is preferably provided with at least one barrier layer between a base paper and the resin cured by irradiation with electron beams. Such substrates are disclosed in detail in Japanese Patent Publication No. 124336/1984.

The white pigment used in the light-sensitive silver halide color photgraphic material according to the second aspect of this invention is not particularly limited, but preferably includes inorganic white pigments such as barium sulfate, titanium oxide, barium carbonate, talc, magnesium oxide and kaolin. Of these, two compounds, barium sulfate and titanium oxide are preferred. These may be used singularly or in combination of two or more kinds.

Content of the white pigment is preferably in the range of from 5 to 50 parts by weight based on 100 parts by weight of the synthetic polyester. Particle size of the white pigment is preferably in the range of from 0.5 to 50 μm. When the white pigment has the particle size exceeding this range, it is preferred to control the particle size distribution so as to be not more than 0.1 %.

The synthetic polyester film according to this invention may be an opaque layer formed by coating its one side or both sides with the above white pigment, or alternatively it may be an opaque layer formed by having the above white pigment contained by dispersion in the layer and applied with molecular orientation. Further, it may be an opaque layer comprising two layers formed by the coated layer and the molecular oriented layer.

The substrate of the thermoplastic resin film according to this invention constitutes, or has, the opaque layer comprising the synthetic polyester film mentioned above.

The method of coating the white pigment is not particularly limited, but there may be employed the methods such as air doctor coating, blade coating, squeeze coating, air knife coating, reverse roll coating and caster coating. The above-mentioned opaque layer is formed by the presence of white pigment based on these coating methods.

Alternatively, the opaque layer is formed based on the presence of voids formed by having the white pigment contained by dispersion in the polyester and applied with molecular orientation.

As a means for having the pigment contained by dispersion, it is possible to have it contained, for instance, by forming a slurry in glycol as practiced in the production of polyesters.

The means for applying the molecular orientation is not particularly limited, and conventional known methods may be employed. As known methods, it has been practiced to supply polyester to the surface of a cooling mold by melt extrusion through means of a slot die and to quench the polyester on the surface thereof to make it amorphous, or draw it in one direction or two mutually vertical directions at a high temperature to effect the molecular orientation, followed by heat setting (see British Patent No. 838,708). Drawing ratio, drawing temperature and heat setting temperature are not particularly limited. For instance, when the drawing ratio is greater, the larger voids are formed and the higher opacity is obtained. Also, when the drawing temperature and the heat setting temperature is lower, larger voids are obtained in general. In the case of a substrate of biaxially oriented film of polyethyleneterephthalate, it is preferred to prepare it at the drawing temperature of about 90° C., selecting the drawing ratio in the range of from 3.):1 to 4.2:1 and using the heat setting temperature of about 210° C.

The opacity of film is determined by the thickness of a film, and can be represented by "whole light transmittance" to be measured by ASTM Test Method D-1003-61. The whole light transmittance of the film substrate according to this invention and having the film thickness of 150 μm, when measured by this test method, is 20% or less, particularly preferably 10% or less.

In this invention, other additives than the above white pigment may be contained in the polyester film.

Such other additives may include pigments other than the above-mentioned brightening agents and dyes.

The polyester used in this invention can be obtained by combining, for instance, one or more of dicarboxylic acids or their lower alkyl diesters and one or more of glycols together with monocarboxylic acids such as pivarlic acid. The above dicarboxylic acids include terephthalic acid, isophthalic acid, phthalic acid, 2,5-, 2,6-, and 2,7-napthalene dicarboxylic acids, succinic acid, sebacic acid, adipic acid, azelaic acid, diphenylcarboxylic acid and hexahydroterephthalic acid or bis-p-carboxylphenoxyethane. The above-mentioned glycols include ethylene glycol, 1,3-propanediol, 1,4-butanediol, neopentyl glycol and 1,4-cyclohexanedimethanol. A heat set film of polyethyleneterephthalate applied with the biaxial orientation and the heat setting is particularly preferred in this invention.

The light-sensitive silver halide color photographic material according to this invention is obtained by applying a light-sensitive silver halide emulsion layer by coating on one side or both sides of the above substrate or thermoplastic resin film.

Each of the silver halide emulsion layers according to this invention may contain a coupler, namely, a compound capable of forming a dye by the reaction with an oxidant of a color developing agent.

In this invention, as the above coupler, there may be used yellow couplers, magenta couplers and cyan couplers which have been conventionally known. These couplers may be either of the so-called two equivalent type or four equivalent type. Also, it is possible to use a diffusible dye emission type coupler in combination with these couplers.

The yellow coupler may include ring-opened ketomethylene compounds conventionally used, and in addition those couplers which are called two equivalent couplers including active site o-aryl-substituted couplers, active site o-acyl-substituted couplers, active site hydantoin compound-substituted couplers, active site urazole compound-substituted couplers, active site succinimide compound-substituted couplers, active site fluorine-substituted couplers, active site chlorine- or bromine-substituted couplers, and active site o-sulfonyl-substituted couplers, which are effectively used in this invention. Specific examples of these yellow couplers are disclosed in U.S. Pat. Nos. 2,875,057; 3,263,506; 3,408,194; 3,551,155; 3,582,322; 3,725,072 and 3,891,445; West German Patent No. 15 47 868; West German Unexamined Patent Publications (OLS) No. 22 19 917, No. 22 61 361 and No. 24 14 006; British Patent No. 1.425,020; Japanese Patent Publication (KOKOKU) No. 10783/1976; and Japanese Unexamined Patent Publications (KOKAI) No. 26133/1972, No. 73147/1973, No. 102636/1976, No. 6341/1975, No. 123342/1975, No. 130442/1975, No. 21827/1976, No. 87650/1975, No. 82424/1977, No. 115219/1977 and No. 95346/1983.

The magneta coupler used in this invention may include compounds of pyrazolone type, pyrazolotriazole type, pyrazolinobenzimidazole type and indazolone type. These magenta couplers may be not only the four equivalent type couplers but also the two equivalent type couplers, similarly to the case of the yellow couplers. Specific examples of these magenta couplers are disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; West German Patent No. 18 10 464; West German Unexamined Patent Publications (OLS) No. 24 08 665, No. 24 17 945, No. 24 18 959 and 24 24 467; Japanese Patent Publication (KOKOKU) No. 6031/1965; Japanese Unexamined Patent Publications (KOKAI) No. 20826/1976, No. 58922/1977, No. 129538/1974, No. 74027/1974, No. 159336/1975, No. 42121/1977, No. 74028/1974, No. 60233/1975, No. 26541/1976 and No. 55122/1978 and No. 35858/1982.

Useful cyan couplers which may be further used in this invention may include, for example, couplers of phenol type and naphthol type. These couplers may be not only the four equivalent type couplers but also the two equivalent type couplers, as in the case of the yellow couplers. Specific examples of these cyan couplers are disclosed in U.S. Pat. Nos. 2,369,929, 2,434,272, 2,474,293, 2,521,908, 2,895,826, 3,034,892, 3,311,476, 3.458,315, 3,476,563, 3,583,971, 3,591,383, 3,767,411 and 4,004,929; West German Unexamined Patent Publications (OLS) No. 24 14 830 and No. 24 54 329; and Japanese Unexamined Patent Publications (KOKAI) Nos. 59838/1973, No. 26034/1976, No. 5055/1973, No. 146827/1976, No. 69624/1977, No. 90932/1977 and 95346/1983.

In order to have these couplers contained in the silver halide emulsion according to this invention, they may be added as an alkaline solution when the couplers are alkali soluble, or alternatively, when they are oil soluble. It is preferred that the couplers be added to the silver halide emulsion by dissolving them in a solvent of high boiling point, optionally in combination with a solvent of low boiling point, in accordance with the methods disclosed, for instance, in each of the specifications of U.S. Pat. Nos. 2,322,027, 2,801,170, 2,801,171, 2,272,191 and 2,304,940 until they are dispersed therein in the form of fine particles. In this instance, other hydroquinone derivatives, ultraviolet absorbents, anti-discoloration agents, etc. may be used in combination, if necessary. Also, two or more kinds of couplers may be used by mixing them, without any inconveniences. Referring more specifically to a method of adding the couplers which is preferred in this invention, one or two or more kinds of the couplers is/are added to the silver halide emulsion by dissolving it/them in a high boiling solvent such as organic amides, carbamates, esters, ketones, urea derivatives, ethers, hydrocarbons, in particular, di-n-butylphthalate, tricresylphosphate, triphenylphosphate, di-isooctylazelate, di-n-butylsebacate, tri-n-hexylphosphate, N,N-di-ethyl-caprylamidebutyl N,N-diethyllaurylamide, n-pentadecylphenyl ether, di-octylphthalate, n-nonylphenol, 3-pentadecylphenylethyl ether, 2,5-di-sec-amylphenylbutyl ether, monophenyl-di-o-chlorophenylphosphate and fluoroparaffin, and/or a low boiling solvent such as methyl acetate, ethyl acetate, propyl acetate, butyl acetate, butyl propionate, cyclohexanol, diethylene glycol monoacetate, nitromethane, carbon tetrachloride, chloroform, cyclohexanetetrahydrufuran, methyl alcohol, acetonitrile, dimethylformamide, dioxane and methyl ethyl ketone, together with, if necessary, other couplers, hydroquinone derivatives, anti-discoloration agents, ultraviolet absorbents, etc., and mixing with an aqueous solution containing an anionic surfactant such as alkylbenzenesulfonic acid and alkylnaphthalenesulfonic acid and/or a nonionic surfactant such as sorbitanesesquioleic aid ester and sorbitanmonolauric acid ester and/or a hydrophilic binder such as gelatin, followed by dispersion by emulsification with use of a high-speed rotating mixer, a colloid mill, a ultrasonic wave dispersing device, etc.

Alternatively, the above coupler(s) may be dispersed by use of a latex dispersion method. The latex dispersion method and the effects obtainable therefrom are disclosed in each of the official bulletins of Japanese Unexamined Patent Publications (KOKAI) No. 74538/1974, No. 59943/1976 and No. 32552/1979 or in Research Disclosure No. 148, pp 50, 77–79 (August, 1976).

The latex suitable for this invention includes, for example, homopolymers, copolymers and terpolymers of monomers such as styrene, acrylate, n-butyl acrylate, n-butyl methacrylate, 2-acetoacetoxyethyl methacrylate, 2-(methacryloyloxy)ethyl trimethylammoniummethosulfate, sodium 3-(methacryloyloxy)propane-1-sulfonate, N-isopropyl acrylamide, N-[2-(2-methyl-4-oxopentyl)]-acrylamide and 2-acrylamide-2-methylpropanesulfonate.

The light-sensitive silver halide color photographic material of this invention may further contain various kinds of additives for photography. For example, there may be used antifoggants, stabilizers ultraviolet absorbents, color contamination preventive agents, brightening agents, color image discoloration preventive agents, antistatic agents, hardeners, surfactants, plastisizers, wetting agents, etc. as dosclosed in Research Disclosure No. 17643.

The hydrophilic colloid used in the light-sensitive silver halide color photographic material of this invention in order to prepare an emulsion, includes any of proteins such as gelatin, derived gelatin, a graft polymer of gelatin and other polymer, albumin and casein; cellulose derivatives such as a hydroxyethylcellulose derivative and carboxymethylcellulose; starch derivatives; synthetic hydrophilic polymers which are monomers or copolymers of polyvinyl alcohol, polyvinyl imidazole, polyacrylamide, etc.

The silver halide emulsion usable in this invention may be any of those employing silver halides such as silver chloride, silver bromide, silver iodide, silver chlorobromide, silver chloroiodide, silver iodobromide, silver chloroiodobromide and mixture of these. In order to have the effect of the invention shown most effectively, silver iodide is particularly preferred to be contained in an amount of 0.1 mol % or more. Particularly desirable effect is shown when the total amount of the silver including silver halides is 20 mg/dm$^2$ or more.

The foregoing light-sensitive silver halide color photographic material is, after exposure to light, subjected to color developing processing, and, after processing by use of the processing solution having fixing ability according to this invention, further subjected to stabilizing processing.

Here, a typical example of the processing solution having fixing ability includes a fixing solution and a bleach-fixing solution. When the fixing solution is used, a processing by bleaching solution is carried out between the color developing processing and the processing by fixing solution.

In this invention, the stabilizing processing is meant to be a processing for a stabilizing processing without substantially any water washing step, in which the stabilizing processing is carried out immediately after processing by the processing solution having fixing ability. The processing solution used for this stabilizing processing is called a stabilizing solution, and a tank for such processing is called a stabilizing bath or a stabilizing tank.

In this invention, the stabilizing processing requires one or more tanks, preferably 1 to 3 tanks, and at most 9 or less tanks. Namely, when the amount of replenishing solutions is constant, the more the number of the tanks is, the lower the concentration of stain components in a final stabilizing bath becomes. However, the total amount of solutions in tanks increases with the number of tanks to lower the rate of the renewal of solutions in tanks by the replenishing solution and elongate the residence time of the stabilizing solution. Such elongation of the residence time of the solutions in tanks impairs the preservability of the solutions and undesirably promotes the generation of precipitation. Hereinafter, all of processing solutions to be used in the processing steps subsequent to the processing by the processing solution having fixing ability are called stabilizing solutions, and also a step subsequent to the processing step by the processing solution having fixing ability is called a stabilizing processing step.

In this invention, "carrying out the stabilizing processing without substantially any water washing step" is meant to be a case where the volume of bleaching solution, bleach-fixing solution or fixing solution brought into a most anterior stabilizing tank is 1/2000 or more, preferably 1/500 or more, most preferably 1/250 or more, relative to that of stabilizing solution. If the concentration of bleaching solution, bleach-fixing solution or fixing solution in the most anterior stabilizing tank is kept less than 1/2000, processings such as rinsing, auxiliary water washing and processing by washing-accelerating bath may be carried out for a very short period of time according to a single tank or multiple tank countercurrent system. In particular, it is preferred that the concentration of bleaching solution, bleach-fixing solution or fixing solution in the stablizing solution is 500 ppm or more.

In this invention, the pH of the stabilizing solution is preferably in the range of 2.0 to 10, and in particular, it is preferred to adjust it to pH 3.0 to 9.0 from the viewpoint of stability in image preservation.

In order to enhance the stability in image preservation, the stabilizing solution used in this invention may contain, for instance, chelating agents (such as polyphosphate, aminopolycarboxylate, phosphonocarboxylate and aminophosphonate), salts of organic acids (such as citric acid, acetic acid, succinic acid, oxalic acid and benzoic acid), pH-adjusting agents (such as sulfite, phosphate, borate, hydrochloric acid and sulfuric acid), mildew-proofing agents (such as phenol derivatives, catechol derivatives, imidazole derivatives, triazole derivatives, thiabendazole derivatives, organic halogen compounds and other mildew-proofing agents known as slime-controlling agents in paper-pulp industries), brightening agents, sufactants, antiseptics, organic sulfur compounds, onium salts, formalin, ect.

As preferable chelating agents, polyphosphate, aminopolycarboxylate, oxycarboxylate, polyhydroxyl compound, organic phosphate, etc. may be used, and, in particular, aminopolycarboxylate and organic phosphate are useful for obtaining desired effects of this invention.

Specifically, the chelating agents include, but in no way limited by, the following.

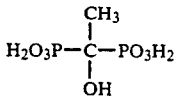

(1)

-continued

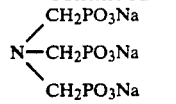
(2)

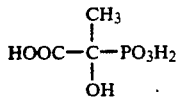
(3)

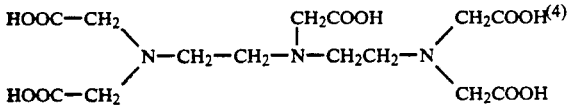
(4)

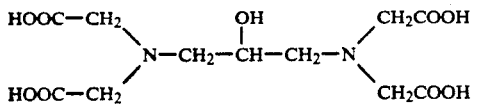
(5)

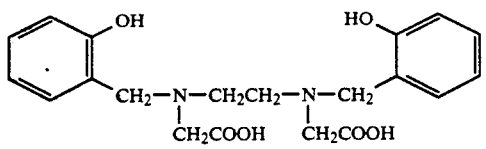
(6)

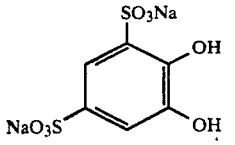
(7)

Usable amount of the chelating agent to be added is in the range of from 0.05 to 40 g, preferably 0.1 to 20 g, per one liter of the stabilizing solution.

Next, it is preferred that the stabilizing solution used in this invention contains metal salts. Such metal salts may include salts of metals such as Ba, Ca, Ce, Co, In, La, Mn, Ni, Pb, Sn, Zn, Ti, Zr, Mg, Al, and Sr, and these can be supplied as inorganic salts such as halide, hydroxide, sulfate, carbonate, phosphate and acetate, or water soluble chelating agents. The metal salts may be added in an amount ranging from $1\times10^{-4}$ to $1\times10^{-1}$ mole, preferably $4\times10^{-4}$ to $2\times10^{-2}$ mole, more preferably $8\times10^{-4}$ to $1\times10^{-2}$ mole, per one liter of the stabilizing solution.

Additives to the stabilizing solution according to this invention may include brightening agents, organic sulfur compounds, onium salts and hardening agents other than the aforementioned compounds, and may further include polyvinylpirrolydone (such as PVP K-15 and Rubiscoal K-17, produced by BASF-wyandotte Co.).

It is particularly desired for the stabilizing solution in this invention to contain the following compounds:

[A] Phenol series compounds
[B] Thiazoline series compounds
[C] Triazine series compounds
[D] Morpholine series compounds
[E] Imidazole series compounds
[F] Guanidine series compounds Exemplary compounds of the above [A] to [F] may include, but in no way limited by, the following.

Exemplary Compounds (1) sodium octphenylphenolate
(2) 2-octyl-4-isothiazoline
(3) benzisothiazoline-3-on
(4) 2-methyl-4-isothiazoline-3-on
(5) 5-chloro-2-methyl-4-isothiazoline-3-on
(6) 2-thiomethyl-4-ethylamino-6-(1,2-dimethylpropylamino)-s-triazine
(7) hexahydro-1,3,5-tris(2-hydroxyethyl)-s-triazine
(8) 4-(2-nitrobutyl)morpholine
(9) 4-(3-nitrobutyl)morpholine
(10) 2-(4-thiazolyl)benzimidazole
(11) dodecyl guanidine hydrochloride The above compounds [A] to [F] may be used in an amount ranging from 0.001 to 50 g per one liter of the stabilizing solution, and preferably 0.01 to 20 g to obtain desirable results.

In the stabilizing solution used in this invention, at least one of the above compounds [A] to [F] may be contained, but other soluble iron complex salts may preferably be contained.

Exemplary compounds of soluble iron salts include inorganic ferric and ferrous salts such as ferric chloride, ferric sulfate, ferric nitrate, ferrous chloride, ferrous sulfate and ferrous nitrate; carboxylic acid iron salts such as ferric acetate and ferric citrate; and every kind of ion salts. The compounds which may form complex salts of these iron salts may include the compounds represented below by General Formulae [II] to[XII]:

General Formula [II]

$$M_mP_mO_{3m}$$

wherein M represents a hydrogen atom, an alkali metal or ammonium; and m is an integer of 3 to 6.

General Formula [I]

$$M_{n+2}P_nO_{3\,n+1}$$

wherein M has the same meaning as in Formula [II], and n is an integer of 2 to 20.

General Formula [IV]

$$B\text{-}A^1\text{-}Z\text{-}A^2\text{-}C$$

General Formula [V]

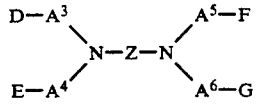

In Formulae [IV] and [V], $A^1$ to $A^6$ each represent a substituted or unsubstituted alkyl group; Z represents an alkyl group, a group of —R—O—R— or —RORO-R—(wherein R is an alkyl group) or a group of $>N—A^7$ (wherein $A^7$ is hydrogen, hydrocarbon, lower aliphatic carboxylic acid or lower alcohol); and B, C, D, E, F and G each represent a group of —OH, —COOM or $—PO_3M_2$ (wherein M is hydrogen, alkali metal or ammonium).

General Formula [VI]

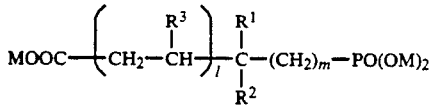

wherein $R^1$ represents a group of —COOM or —PO-$(OM)_2$ (wherein M is a hydrogen atom, an alkali metal or ammonium); $R^2$ represents a hydrogen atom or an alkyl group having 1 to 4 carbon atoms, a group of $-(CH_2)_nCOOM$ (wherein M is as defined above); $R^3$ represents a hydrogen atom or a group of —COOM (wherein M is as defined above); l and m are each 0 or 1; and n is an integer of 1 to 4.

General Formula [VII]

$$R^4N(CH_2PO_3M_2)_2$$

wherein $R^4$ represents a lower alkyl group, an aryl group, an aralkyl group, a nitrogen-containing 6-membered ring which may be substituted with a group of —OH, $-OR^5$ (wherein $R^5$ is an alkyl group having 1 to 4 carbon atoms), $-PO_3M_2$, $-CH_2PO_3M_2$, $-N(CH_2PO_3M_2)_2$, $-COOM_2$ or $-N(CH_2COOM)_2$; and M, including M in $R^4$, represents a hydrogen atom, an alkali metal or ammonium.

General Formula [VIII]

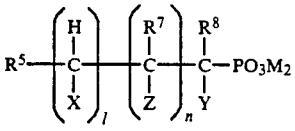

wherein $R^6$, $R^7$ and $R^8$ each represent a hydrogen atom, an alkyl gruop, a group of —OH or $-NJ_2$ (wherein J is a hydrogen atom, a group of —OH, a lower alkyl group or a group of $-C_2H_4OH$); X, Y and Z each represent a hydrogen atom or a group of —OH, —COOM or $-PO_3M_2$; M represents a hydrogen atom, an alkali metal or ammonium; and l and n are as defined in General Formula [VI].

General Formula [IX]

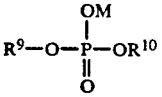

wherein $R^9$ and $R^{10}$ represents a hydrogen atom, an alkali metal and ammonium, an alkyl group having 1 to 12 carbon atoms, an alkenyl group or a cyclic alkyl group.

General Formula [X]

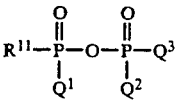

wherein $R^{11}$ represents an alkyl group having 1 to 12 carbon atoms, an alkoxy group having 1 to 12 carbon atoms, a dialkylamino group having 2 to 12 carbon atoms, an amino gruop, an aryloxy group having 1 to 24 carbon atoms, an arylamino group having 6 to 24 carbon atoms or an amyloxy group; $Q^1$ to $Q^3$ each represent a group of —OH, an alkoxy group having 1 to 24 carbon atoms, an aralkyloxy group, an aryloxy group, a group of $-OM_3$ (wherein $M_3$ is cation), an amino group, a morpholino group, a cyclic amino group, an alkylamino group, a dialkylamino gruop, an arylamino group or an alkyloxy group.

General Formula [XI]

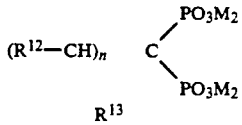

wherein $R^{12}$ and $R^{13}$ each represent a hydrogen atom or a lower alkyl group; and M represents a hydrogen atom, an alkali metal or ammonium.

General Formula [XII]

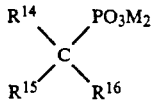

wherein $R^{14}$ to $R^{16}$ each represent a hydrogen atom, an alkyl group which may be substituted with a group of —OH, $-OC_nH_{2n+1}$ (n=1 to 4), $-PO_3M_2$, $-CH_2PO_3M_2$, $-NR_2$ (wherein R is an alkyl group) or $-N(CH_2PO_3M_2)_2$; and M represents a hydrogen atom, an alkali metal or ammonium.

Besides these compounds represented by General Formulae [II] to [XII], there may be mentioned citric acid, glycine, etc. However, the compounds represented by the above General Formulae can exhibit more excellent effects.

Specific examples of the above compounds represented by General Formulae [II]to [XII]include those disclosed in Japanese Unexamined Patent Publication (KOKAI) No. 14834/1983. Particularly preferably, they include aminopolycarboxylic acid iron complex ions or organic phosphinic acid iron (III) complex salts.

Soluble iron salts used in this invention may be added as iron ions in an amount ranging from 10 mg to 8 g, preferably from 50 mg to 2 g per one liter of the stabilizing solution. In a continuous processing method in which the processing steps comprise a plural number of stabilizing tanks (or baths), the processing is carried out by a countercurrent method and the replenishment is effected beginning with the final tank, the preferable amount of the above soluble iron salt corresponds to the concentration of the same in the final tank of the stabilizing tanks.

In this invention, the silver complex ions allowed to be present in the stabilizing tanks may be any of those which are soluble silver ions, namely, any of silver bromide complex ions, silver iodide complex ions, silver chloride complex ions, silver thiosulfate complex ions, silver sulfite complex ions, silver acetate complex ions, silver thiocyanate complex ions, etc.

When the necessary amount is present, these are preferably delivered from the processing solution having fixing ability, and its necessary concentration is determined by the amount of replenishment of the stabilizing solution. Namely, when the amount of replenishment of the stabilizing solution is small, the concentration of the silver complex ions increases more desirably.

The concentration of the silver complex ions in the final tank of the stabilizing tanks ranges from $2\times10^{-5}$ mole/*l* to $2\times10^{-1}$ mole, preferably $6\times10^{-5}$ mole to $1\times10^{-3}$ mole/*l*.

Particularly desired compounds added to the stabilizing solution used in this invention include ammonium compounds. They are supplied by ammonium salts of various kinds of inorganic compounds, and specifically include ammonium hydroxide, ammonium bromide, ammonium carbonate, ammonium chloride, ammonium hypophosphite, ammonium phosphate, ammonium phosphite, ammonium fluoride, acidic ammonium fluoride, ammonium fluoroborate, ammonium arsenate, ammonium hydrogencarbonate, ammonium hydrogenfluoride, ammonium hydrogensulfate, ammonium sulfate, ammonium iodide, ammonium nitrate, ammonium pentaborate, ammonium acetate, ammonium adipate, ammonium aurinetricarbonylate, ammonium benzoate, ammonium carbamate, ammonium citrate, ammonium diethyldithiocarbamate, ammonium formate, ammonium hydrogenmalate, ammonium hydrogenoxalate, ammonium hydrogenphthalate, ammonium hydrogentartrate, ammonium lactate, ammonium malate, ammonium maleate, ammonium oxalate, ammonium phthalate, ammonium picrate, ammonium pyrrolidinedithiocarbamate, ammonium salicylate, ammonium succinate, ammonium sulfanilate, ammonium tartrate, ammonium thioglycolate, 2,4,6-trinitrophenol ammonium, etc.

These ammonium compounds may be used by adding in an amount ranging from 0.05 to 100 g, preferably from 0.1 to 20 g per one liter of the stabilizing solution.

Processing temperature when the stabilizing processing is carried out may range from 15° C. to 60° C., preferably from 20° C. to 40° C. Also, processing time more preferably, the shorter it is from the viewpoint of speedy processing, but it may range in general from 10 seconds to 10 minutes, preferably from 20 seconds to five minutes. When the stabilizing processing is carried out in a multiple tank system, it is preferably carried out in a shorter time in the tanks of anterior stages, and in a longer time in the tanks of posterior stages. In particular, it is desired that the subsequent processing be a time of 20% to 50% increase of the time in the anterior tank. Further, the stabilizing processing steps may comprise multiple tanks, employing a countercurrent system where the replenishing solution is supplied from a posterior tank and allowed to overflow subsequently into an anterior tank, but most preferably should comprise a single tank.

In this invention, the fixing processing is carried out in a processing bath containing a soluble complex-forming agent (a fixing agent) capable of making a silver halide soluble as a silver halide complex salt, in which not only an ordinary fixing solution but also a bleach-fixing solution, a combined developing and fixing solution and a combined developing and bleach-fixing solution may be included.

The fixing agent includes thiosulfate, thiocyanate, iodide, bromide, thioether and thiourea. In this invention, preferable fixing agent is thiosulfate, and most preferable fixing agent is ammonium thiosulfate. These fixing agents may be used in an amount capable of dissolving 5 g/liter or more, preferably 50 g/liter or more, more preferably 70 g/liter or more of silver halide.

As a bleaching agent used in the bleaching solution or the bleach-fixing solution, there may be employed a metal complex salt of organic acid. The metal complex salt has actions to oxidize metallic silver formed by development to change it into silver halides and, at the same time, to color uncolored portions of couplers, and has the construction in which ions of metals such as iron, cobalt and copper are coordinated with organic acids such as aminopolycarboxylic acid, oxalic acid and citric acid. Most preferable organic acids used for the formation of such metal complex salts of organic acids may include the following:

(1) Ethylenediaminetetraacetic acid ($\overline{M}w=292.5$ )
(2) Diethylenetriamine pentaacetic acid ($\overline{M}w=393.27$)
(3) Diethylenetriamine pentamethylenephosphonic acid ($\overline{M}=573.12$)
(4) Cyclohexanediamine tetraacetic acid ($\overline{M}w=364.35$)
(5) Cyclohexanediamine tetramethylenephosphonic acid ($\overline{M}w=508.23$)
(6) Triethylenetetramine hexaacetic acid ($\overline{M}w=494.45$)
(b 7) Triethylenetetramine hexamethylenephosphonic acid ($\overline{M}w=710.27$)
(8) Glycol ether diamine tetraacetic acid ($\overline{M}w=380.35$)
(9) Glycol ether diamine tetramethylenephosphonic acid ($\overline{M}w=524.23$)
(10) 1,2-Diaminopropane tetraacetic acid ($\overline{M}w=306.27$)
(11) 1,2-diaminopropane tetramethylenephosphonic acid ($\overline{M}w=450.15$)
(12) Methyliminodiacetic acid ($\overline{M}w=147.13$)
(13) Methyliminodimethylenephosphonic acid ($\overline{M}w=219.07$)
(14) 1,3-diaminopropane-2-ol tetraacetic acid ($\overline{M}w=322.27$)
(15) 1,3-diaminopropane-2-ol tetramethylenephosphonic acid ($\overline{M}w=466.15$)
(16) Ethylenediamine diorthohydroxyphenylacetic acid ($\overline{M}w=360.37$)
(17) Ethylenediamine diorthohydroxyphenylmethylenephosphonic acid ($\overline{M}w=432.31$)
(18) Ethylenediamine tetramethylenephosphonic acid ($\overline{M}w=436.13$)
(19) Ethylenediamine-N-(β-oxyethyl)-N,N',N'-triacetic acid (Mw=278.26)
(20) Nitrilotetraacetic acid ($\overline{M}w=191.14$)
(21) Iminodiacetic acid ($\overline{M}w=133.10$)
(22) Dihydroxyethyl glycine citric (or tartaric) acid ($\overline{M}w=163.17$)
(23) Ethyletherdiaminetetraacetic acid ($\overline{M}w=336.30$)
(24) Ethylenediaminetetrapropionic acid ($\overline{M}w=348.35$)
(25) Phenylenediaminetetraacetic acid ($\overline{M}w=340.29$)
(26) Disodium ethylenediaminetetraacetate ($\overline{M}w=336.23$) (27) Tetra(trimethylammonium) ethylenediaminetetraacetate ($\overline{M}w=351.36$)
(28) Tetrasodium ethylenediaminetetraacetate ($\overline{M}w=380.21$)
(29) Pentasodium diethylenetriaminepentaacetate ($\overline{M}w=402.20$)
(30) Sodium ethylenediamine-N- (β-oxyethyl)-N,N',N'-triacetate ($\overline{M}w=300.25$)
(31) Sodium propylenediaminetetraacetate ($\overline{M}w=328.26$)
(32) Sodium nitrilotriacetate ($\overline{M}w=213.13$)
(33) Sodium cyclohexanediaminetetraacetate ($\overline{M}w=386.34$)

Of the above, the compounds (1) to (18) are preferably used in this invention, and ferric complex salts of these organic acids, comprising free acid having molecular weight (weight average molecular weight) of 300 or more, are preferred.

Most preferred organic acid ferric complex salts may include ferric complex salts of the compounds of (1), (2), (4) and (6) in the above.

The above ferric complex salts of the organic acids may be used as free acids (hydrogen salts), alkali metal salts such as sodium salt, potassium salt, lithium salt, or ammonium salt, or water soluble amine salts such as triethanolamine salt. Of these, potassium salt, sodium salt and ammoium salt are preferably used. These ferric complex salts may be used singularly, or may be used in combination of two or more kinds. These may be used in an amount to be selected optionally, and, because of generally high oxidation power, may be used in lower concentration than other aminopolycarboxylic acid salts, although the amount must be selected depending on the silver amounts in the light-sensitive materials to be processed, the composition of silver halide, etc. For instance, they may be used in an amount of 0.01 mole or more, preferably 0.05 to 0.6 mole per one liter of the solution to be used. In the replenishing solution, it is desired that these are used by being concentrated to the maximum solubility in order to effect the concentrated low replenishment.

The bleaching solution and the bleach-fixing solution may be used at pH 0.2 to 9.5, preferably 4 to 9, more preferably 5.5 to 8.5. The temperature employed for the processing may be 80° C. or lower, preferably 55° C. or lower. It is most preferred to employ the temperature of 45° C. or lower while controlling the evaporation or the like.

A bleaching solution which may be used before the processing by the processing solution having fixing ability may contain various additives together with the organic acid ferric complex salts used as the bleaching agent, and may preferably contain, in particular, alkali halides or ammonium halides including, for example, potassium bromide, sodium bromide, sodium chloride, ammonium bromide, potassium iodide, sodium iodide, ammonium iodide, etc. Also, there may be suitably added a pH-buffering agent such as borate, oxalate, acetate, carbonate and phosphate; a solubilizing agent such as triethanolamine; and other additives generally known to be added to the bleaching solution, such as acetylacetone, phosphonocarboxylic acid, poly phosphoric acid, organic phosphonic acid, oxycarboxylic acid, polycarboxylic acid, alkylamines and polyethyleneoxides.

As the above bleach-fixing solution, there may be also used a bleach-fixing solution composed by adding a small amount of a halogen compound such as potassium bromide, a bleach-fixing solution composed by adding on the contrary a large amount of a halogen compound such as potassium bromide and ammonium bromide, or a special type of bleach-fixing solution composed by combining the above bleaching agent with a large amount of the halogen compound such as potassium bromide.

Besides potassium bromide, the above halogen compound may include hydrogen chloride, hydrogen bromide, lithium bromide, sodium bromide, ammonium bromide, potassium iodide, sodium iodide, ammonium iodide, etc.

As in the case of the bleach-fixing solution, the above bleaching solution may contain a pH-buffering agent comprised of various salts such as boric acid, sodium tetraborate, sodium hydroxide, potassium hydroxide, sodium carbonate, potassium carbonate, sodium bicarbonate, potassium bicarbonate, acetic acid, sodium acetate and ammonium hydroxide, which may be used singularly or in combination of two or more ones. It may further contain various brightening agents or antifoaming agents, and surfactants or antifungal agents. It may also optionally contain preservatives such as hydroxyamine, hydrazine, sulfite, metabisulfite and an adduct of bisulfite with aldehyde or ketone compound; organic chelating agents such as acetylacetone, phosphonocarboxylic acid, polyphosphoric acid, organic phosphonic acid, oxycarboxylic acid, polycarboxylic acid, dicarboxylic acid and aminopolycarboxylic acid; stabilizing agents such as nitroalcohol and nitrate; solubilizing agents such as alkanolamine; antistain agents such as organic amine; other additives; and organic solvents such as methanol, dimethylformamide and dimethylsulfoxide.

In the processing method of this invention, the most preferable processing system is to carry out bleaching or bleach-fixing immediately after the color development. However, the bleaching or bleach-fixing processing may be carried out after carrying out processings such as water washing or rinsing or stop after the color development, or a prebath containing a bleach accelerating agent may be used as a processing solution precedent to the bleaching or bleach-fixing. Besides the above steps, known supplemental steps such as hardening, neutralization, black and white development, reversing and washing with a small amount of water may be added optionally.

Typical examples of preferable processing method include the following:

(1) Color developing→Bleach-fixing→Stabilizing (2) Color developing→Bleach-fixing→First stabilizing→Second stabilizing (3) Color developing→Stabilizing→Bleach-fixing →Stabilizing (4) Color developing→Fixing→Bleach-fixing→ Stabilizing (5) Color developing→Bleaching→Stabilizing→Fixing→First stabilizing→Second stabilizing (6) Color developing→Bleaching→Fixing→Stabilizing (7) Color developing→Bleaching→Fixing→First stabilizing→Second stabilizing (8) Black and white developing→Water washing (or stabilizing→Reversing→Color developing→Bleaching→Fixing→Stabilizing (9) Prehardening→Neutralizing→Black and white developing→stop→color developing→Bleaching →Fixing→Stabilizing It is preferred that various inorganic metal salts are added to the bleach-fixing solution. It is also preferred that these inorganic metal salts are added after being formed into metal complex salts with various chelating agents.

An aromatic primary amine color developing agent employed in the color developing solution used prior to the processing by the bleaching or bleach-fixing solution includes known agents widely used in various color photographic processing. These developing agents comprises an aminophenol type derivative and a p-phenylenediamine type derivative. These compounds are generally used in the form of a salt, for example, in the form of hydrochloride or sulfate since they are stabler in such a form than in a free state. These compounds are used generally in concentration of about 0.1 g to 30 g, preferably about 1 g to 15 g per one liter of the color developing solution.

The aminophenol type developing agent may include, for example, o-aminophenol, p-aminophenol, 5-amino-2-oxytoluene, 2-amino-3-oxytoluene, 2-oxy-3-amino-1,4-dimethylbenzene, etc.

Most useful aromatic primary amine color developing agent includes N,N-dialkyl-p-phenylenediamine type compounds, in which the alkyl group and the phenyl group may be or may not be substituted. Of these, most useful compounds may include N,N-diethyl-p-phenylenediamine hydrochloride, N-methyl-p-phenylenedimine hydrochloride, N,N-dimethyl-p-phenylenediamine hydrochloride, 2-amino-5-(N-ethyl-N-dodecylamino)-toluene, N-ethyl-N-8-methansulfonamido-ethyl-3-methyl-4-aminoaniline hydrochloride, N-ethyl-N-β-hydroxyethyl-animoaniline, 4-amino-3-methyl-N,N-diethylaniline, 4-amino-N-(2-methoxyethyl)-N-ethyl-3-methylaniline-p-toluene sulfonate, etc.

An alkaline color developing solution is preferably used in this invention, and may optionally contain, in addition to the above aromatic primary amine color developing agent, various components usually added to color developing solutions, for example, an alkali agent such as sodium hydroxide, sodium carbonate and potassium carbonate; a softener and a thickening agent such as alkali metal sulfite, alkali metal bisulfite, alkali metal thiocyanate, alkali metal halide, benzyl alcohol, diethylenetriaminetetraacetic acid and 1-hydroxy-ethylidene-1,1-diphosphonic acid. The pH of the color developing solution is usually 7 or more, preferably ranges from about 10 to about 13.

The bleaching solution or bleach-fixing solution according to this invention preferably has the surface tension of 55 dyne/cm or less, more preferably 50 dyne/cm or less, and most preferably 40 dyne/cm or less.

The surface tension of the processing solution having bleaching ability and used in the processing of this invention is measured by the general measurement method disclosed in "Analysis of Surfactant And Test Method Therefor" by Fumio Kitahara, Shigeo Hayano and Ichiro Hara, Kodansha K. K., published March 1, 1982, etc., and in this invention it refers to a value of the surface tension measured at 20° C. by the usual measurement method.

In this invention, the surface tension may be controlled to 55 dyne/cm or less by an optional method with use of any materials, but preferably with use of a surfactant. The surfactant for controlling the surface tension to 55 dyne/cm or less may be supplied by being added to a tank solution from a replenishing solution, or may be supplied from a previous bath by having it adhered to a light-sensitive material. The surfactant may further be added to the bleaching solution or bleach-fixing solution by having it contained in the light-sensitive material.

The surfactant preferably used include especially the compounds represented by General Formulae [XIII] to [XVI] below.

General Formula [XIII]

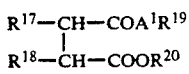

wherein one of $R^{17}$ and $R^{18}$ represents a hydrogen atom and the other of them represents a group represented by the formula: $-SO_3M$ (wherein M represents a hydrogen atom or a monovalent cation); $A^1$ represents an oxygen atom or a group represented by the formula: $-NR^{21}$ (wherein $R^{21}$ represents a hydrogen atom or an alkyl group having 1 to 8 carbon atoms); and $R^{19}$ and $R^{20}$ each represent an alkyl group having 4 to 16 carbon atoms, provided that the alkyl group represented by $R^{19}$, $R^{20}$ or $R^{21}$ may be substituted with a fluorine atom.

General Formula [XIV]

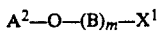

In the formula, $A^2$ represents a monovalent organic group, for example, an alkyl group having 6 to 20 carbon atoms, preferably 6 to 12 carbon atoms (for example, each group of hexyl, heptyl, octyl, nonyl, decyl, undecyl or dodecyl), or an aryl group substituted with an alkyl group having 3 to 30 carbon atoms, in which the substituent is preferably an alkyl gruop having 3 to 12 carbon atoms (for example, each group of propyl, butylpentyl, hexyl, heptyl, octyl, nonyl, decyl, undecyl or dodecyl) and the aryl group includes each group of phenyl, tolyl, xylyl, biphenyl or naphtyl, preferably a phenyl group of a tolyl group. The position at which the alkyl group is bonded to the aryl group may be any of ortho-, meta- and para-positions. B represents ethyleneoxide or propyleneoxide; m represents an integer of 4 to 50; $X^1$ represents a hydrogen atom or a group of $SO_3Y$ or $PO_3Y_2$, wherein Y represents a hydrogen atom, an alkali metal atom (such as Na, K and and Li) or an ammonium ion.

General Formula [XV]

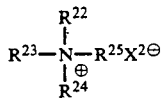

wherein $R^{22}$, $R^{23}$, $R^{24}$ and $R^{25}$ each represent a hydrogen atom, an alkyl group, a phenyl group, provided that the total number of carbon atoms of $R^{22}$, $R^{23}$, $R^{24}$ and $R^{25}$ is 3 to 50; and $X^2$ represents an anion such as a halogen atom, a hydroxyl gruop, a sulfuric acid group, a carbonic acid group, a nitric acid group, an acetic acid group or a p-toluenesulfonic acid group.

General Formula [XVI]

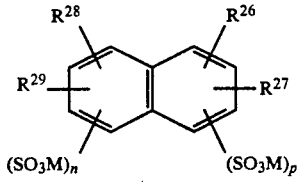

wherein $R^{26}$, $R^{27}$, $R^{28}$ and $R^{29}$ each represent a hydrogen atom or an alkyl group; M is as defined in General Formula [xiii]; and n and p each represent an integer of 0 or 1 to 4 and a value satisfying: $1 \leqq n+p \leqq 8$.

This invention will be described in more detail, but in no way limited, by the following Examples.

EXAMPLE 1

A coating liquid having the composition described below was mixed and dispersed with a ball mill and the resulting mixture was coated on one side of a good quality paper applied with surface size obtained from anionic starch and NaCl and having a basis weight of 100 g/m$^2$, the inner part of which had been subjected to size treatment with an alkaline ketene dimer and polyamide-epichlorohydrin resin, so as to give a thickness of 20 μm, and subsequently electron rays were irradiated thereon at 200 kV and 5 Mrad dosage in a nitrogen gas atmosphere by the use of an electron beam accelerator.

| (Coating liquid) | |
|---|---|
| 3,4-epoxycyclohexylmethyl-3,4-epoxycyclohexylcarboxylate (manufactured by Ciba-Geigy A.G., Araldite, CY-179) | 62 wt. parts |
| 4,4-dimethyldiphenyliodonium hexafluoroacetate | 3 wt. parts |
| Titanium dioxide (particle size: 0.3 μm) | 35 wt. parts |

On the side opposite to the cured coated layer, the above liquid was coated so as to give a thickness of 20 mμ, and then electron beam was irradiated thereon similarly as above to cure it. Subsequently, on the surface of the first coated layer, a silver chlorobromide gelatin emulsion containing a coupler and further a protecting layer were coated, followed by drying to prepare a light-sensitive silver halide color material. The coated sample thus obtained was designated as Sample 1.

Next, a coating having the composition described below was mixed and dispersed with a ball mill and the resulting mixture was coated on one side of a good quality paper having a basis weight of 100 g/m$^2$, which has been subjected to size treatment similarly as above, so as to give a thickness of 20 μm, and subsequently electron beam was irradiated thereon at 200 kV and 5 Mrad dosage by the use of an electron beam accelerator.

| (Coating liquid) | |
|---|---|
| Bisphenol A diglycidyl ether polymer (manufactured by Shell Chemical Co., Epikote 828) | 57 wt. parts |
| p-methoxybenzenediazonium hexafluorophosphate | 3 wt. parts |
| Titanium dioxide (particle size: 0.3 μm) | 40 wt. parts |

On the side opposite to the cured coated layer, the above liquid was coated so as to give a thickness of 20 mμ and electron beam was irradiated thereon similarly as above to cure it. Subsequently, on the surface of the first coated layer, a silver chlorobromide gelatin emulsion containing a coupler and further a protecting layer were coated, followed by drying to prepare a light-sensitive silver halide color material. The coated sample thus obtained was designated as Sample 2.

Further, a coating liquid described below was mixed and dispersed with a ball mill and the resulting mixture was coated on a good quality paper having a basis weight of 100 g/m$^2$, which had been subjected to size treatment similarly as above, so as to give a thickness of 30 μm, and subsequently electron beam was irradiated thereon at 200 kV and 5 Mrad dosage in a nitrogen gas atmosphere by the use of an electron beam accelerator.

| (Coating liquid) | |
|---|---|
| polyester acrylate (molecular weight: approximately 1000; 4 double bonds in a molecule) | 25 wt. parts |
| hexanediol diacrylate | 25 wt. parts |
| trimethylolpropane triacrylate | 15 wt. parts |
| Titanium dioxide (particle size; 0.3 μm) | 35 wt. parts |

On the side opposite to the cured coated layer, the above liquid was coated so as to give a thickness of 30 mμ and electron beam was irradiated thereon similarly as above to cure it. Subsequently, on the surface of the first coated layer, a silver chlorobromide gelatin emulsion containing a coupler and further a protecting layer were coated, followed by drying to prepare a light-sensitive silver halide color material. The coated sample thus obtained was designated as Sample 3.

As a comparative sample, polyethylene mixture was coated on both sides of a good quality paper, which had been subjected to size treatment as above, at a coating amount of about 12 g/m$^2$ according to an extruded coating. This polyethylene mixture contained 10 wt. parts of titanium dioxide. This sample was designated as Comparative Sample.

The samples described above were subjected to exposure in an ordinary manner and then to the following processings. As a comparative processing, water washing was carried out in place of stabilizing processing.

| | Processing step | Processing temperature (°C.) | Processing time |
|---|---|---|---|
| 1 | Color developing | 37.8 | 3 min. 15 sec. |
| 2 | Bleach-fixing | 37.8 | 1 min. 30 sec. |
| 3 | Stabilizing | 30 to 34 | 2 min. 10 sec. |
| 4 | Drying | | |

As a color developing solution, a bleach-fixing solution and a stabilizing solution, solutions having the following compositions were employed:

| [Color developing solution] | |
|---|---|
| Potassium carbonate | 30 g |
| Sodium sulfite | 2.0 g |
| Hydroxyamine sulfate | 2.2 g |
| Potassium bromide | 1.2 g |
| Diethylenetriaminepentaacetic acid | 2.0 g |
| Sodium hydroxide | 3.4 g |
| N-ethylene-N-β-hydroxyethyl-3-methyl-4-aminoaniline hydrochloride | 4.6 g |

made up to one liter with water and adjusted to pH 10.05 with sodium hydroxide.

| [Bleach-fixing solution] | |
|---|---|
| Ethylenediaminetetraacetic acid iron (III) ammonium salt | 50 g |
| Diethylenetriaminepentaacetic acid | 10 g |
| Ammonium thiosulfate (70% solution) | 200 ml |
| Ammonium sulfite (40% solution) | 10 ml |

made up to one liter with water and adjusted to pH 6.8 with aqueous ammonia solution.

| [Stabilizing solution] | |
|---|---|
| 2-Methyl-4-isothiazolin-3-on | 0.004 g |
| 2-Methyl-5-chloro-4-isothiazolin-3-on | 0.02 g |

-continued

| [Stabilizing solution] | |
|---|---|
| 1-Hydroxyethylidene-1,1'-diphosphonic acid | 0.01 g |
| 2-Octyl-4-isothiazolin-3-on | 0.03 g |
| Magnessium chloride | 0.17 g |
| Bismuth chloride | 0.14 g |
| Polyvinyl pyrrolidone | 0.1 g |
| Nitrilotriacetic acid | 3 g |
| Ammonium hydroxide (28% aqueous solution) | 3 g |

made up to one liter with water and adjusted to pH 7.1 with acetic acid and potassium hydroxide.

An automatic processing machine was supplied in full with the above color developing solution, bleach-fixing solution and stabilizing solution, and running tests were made by processing the above color paper on which an image had been printed and by replenishing the above color developing solution, bleach-fixing solution and stabilizing solution in a predetermined amount at an interval of 3 minutes. The amounts replenished were 2.0 ml as for the color developing tank, 2.5 ml as for the bleach-fixing tank and 2.8 ml as for the stabilizing tank per 100 $cm^2$ of the color paper, respectively.

In the automatic processing device, the stabilizing tanks were arranged so that a first tank to a third tank were lined in the direction of flow of the light-sensitive materials, to employ the multiple tank countercurrent system in which replenishment of the solutions was made in the last tank first, the solution overflown from the last tank was introduced to its previous tank, the solution overflown from this tank was further introduced to its further previous tank and finally overflown from the most previous tank was employed.

The processing was continued until the total amount of the stabilizing solutions replenished reached five times the total capacities of the first to the third stabilizing tanks.

The sample after the continuous processing was taken out in a length of 1 m, stored under 80 % RH at 60° C. for 2 weeks and then wound up onto a role to measure stain concentration in the edge parts of the sample. For comparison, samples obtained at the beginning of the running was employed and stored.

Further, unexposed parts and white-exposed parts (maximum concentration parts) of the image parts were also stored under conditions of 80 % RH and 60° C. for 2 weeks. Change in concentration after storage was compared with the initial concentration.

The results are shown in Table 1.

TABLE 1

| Experiment No. | Sample | Density at edge: upon initiation of processing | Density at edge: upon termination of running | Upon termination of running: Yellow stain density: initial concentration | Yellow stain density: after 4 weeks storage | Cyan dye density: initial concentration | Cyan dye density: after 4 weeks storage |
|---|---|---|---|---|---|---|---|
| 1 | Comparative | 0.16 | 0.54 | 0.10 | 0.36 | 2.62 | 2.16 |
| 2 | 1 | 0.10 | 0.22 | 0.10 | 0.12 | 2.67 | 2.39 |
| 3 | 2 | 0.09 | 0.21 | 0.10 | 0.12 | 2.65 | 2.40 |
| 4 | 3 | 0.09 | 0.23 | 0.10 | 0.12 | 2.64 | 2.39 |

As is apparent from Table 1, it is seen that the samples according to this invention are remarkably superior to Comparative sample in edge contamination, in stain at the image parts and also in dye concentration, when they are subjected to non-water washing processing.

Besides the above Example, the samples according to this inventions were subjected to processing with water washing step in place of the processing with the stabilizing solution. However, the significant difference between the present invention and the prior art as shown in the results of Table 1 were not obtained and it was confirmed that the effects were small.

EXAMPLE 2

Experiments were carried out following the same procedures as in Example 1 except that the bleaching agent in the bleach-fixing solution was replaced by the following:

| [Bleaching agent] | |
|---|---|
| (1) Diethylenetriaminepentaacetic acid iron (III) ammonium salt | 80 g/liter |
| (2) Cyclohexanediaminepentaacetic acid iron (III) ammonium salt | 80 g/liter |
| (3) Triethylenetetraminehexaacetic acid iron (III) ammonium salt | 90 g/liter |

As a result, the same results in Example 1 were obtained and the effects of the present invention were confirmed.

EXAMPLE 3

Processing was carried out following the same procedure as in Example 1 except that the titanium oxide used for the substrate of the sample of the present invention was replaced by barium sulfate. As a result, substantially the same results as in Example 1 were obtained.

EXAMPLE 4

Processing with the bleach-fixing solution in Example 1 was replaced by individual processing with a bleaching solution and a fixing solution. Processing times were 1 minutes and 30 seconds, respectively. Processing temperature was 33° C. and Sakura Color CNK-4 type processing agent (produced by Konishiroku Photo Industries, Co., Ltd.) was used as a processing solution.

The same procedures as in Example 1 were followed except for the conditions described above.

The results obtained were substantially the same as in Example 1.

EXAMPLE 5

20 wt. parts of barium sulfate as a white pigment and 80 wt. parts of polyethyleneterephthalate were blended to obtain a composition for forming a film.

The blend obtained was molded by extrusion through a film forming die and then cooled on a rotating rapid cooling drum which had been cooled, to make it amorphous. The film was then drawn at a draw ratio of the longitudinal direction to the transverse direction of 3.4 : 1. The drawing temperature was approximately 90° C.

and the heat setting temperature was approximately 206° C.

The film support obtained was sufficiently opaque and white and thus was adequate to use as a support for photographic printing. This film was used as the sample of the present invention.

A polyethylene mixture was coated on both sides of paper of good quality having basis weight of 80 g/m$^2$, the inner parts of which had been subjected to size treatment in a conventional manner, at a coating amount of approximately 12 g/m$^2$ according to the extruded coating. This polyethylene mixture contained 10 wt. parts of titanium dioxide. This sample was designated as Comparative Sample.

On each of the film bases of the above samples were provided a gelatin layer, and further a red-sensitive silver halide emulsion layer, a green-sensitive silver halide emulsion layer and a blue-sensitive silver halide emulsion layer were coated thereon so that the tatal amount of silver may be 8.7 mg per 100 cm$^2$. On this occasion, α-(4-nitrophenoxy)-α-pivalyl-5-[γ-(2,4-di-t-aminophenoxy) butylamido]-2-chloroacetoanilide was used in the blue sensitive silver halide emulsion layer as the yellow coupler. In the green-sensitive silver halide emulsion layer was used 1-(2,4,6-trichlorophenyl)-3-{[α-(2,4-di-t-amylphenoxy)-acetamide]benzamide}-3}-pyrazolone and 1-(2,4,6-trichlorophenyl)-3-{[α-2,4-di-t-amylphenoxy) acetamido]benzamide}-4-(4-methoxyphenylazo)-5-pyrazolone as the magenta coupler. In the red-sensitive silver halide emulsion layer, was used 1-hydroxy-N-{α-(2,4-t-amylphenoxy)butyl}-2-naphthamide as the cyan coupler. In each of the emulsion layers were added additives such as sensitizing dyes, hardeners and extenders. The light-sensitive silver halide color material thus obtained was used as Sample 4.

This sample was subjected to exposure in an ordinary manner, and then to the following processes.

| | Processing step | Processing temperature (°C.) | Processing time |
|---|---|---|---|
| 1 | Color developing | 37.8 | 3 min. 15 sec. |
| 2 | Bleaching and fixing | 37.8 | 1 min. 30 sec. |
| 3 | Stabilizing | 30 to 34 | 2 min. 10 sec. |
| 4 | Drying | | |

As the color developing solution, bleach-fixing solution and stabilizing solution, solutions having the following compositions were employed:

| [Color developing solution] | |
|---|---|
| Potassium carbonate | 30 g |
| Sodium sulfite | 2.0 g |
| Hydroxyamine sulfate | 2.2 g |
| Potassium bromide | 1.2 g |
| Diethylenetriaminepentaacetic acid | 2.0 g |
| Sodium hydroxide | 3.4 g |
| N-ethyl-N-β-hydroxyethyl-3-methyl-4-aminoaniline hydrochloride | 4.6 g |

made up to one liter with water and adjusted to pH 10.05 with sodium hydroxide.

| [Bleach-fixing solution] | |
|---|---|
| Ethylenediaminetetraacetic acid iron (III) ammonium salt dihydrate | 60 g |
| Diethylenetriaminepentaacetic acid | 10 g |
| Ammonium thiosulfate (70% solution) | 200 ml |
| Ammonium sulfite (40% solution) | 20 ml |
| made up to one liter with water and adjusted to pH 6.8 with aqueous ammonia solution. | |
| [Stabilizing solution] | |
| 2-Methyl-4-isothiazolin-3-on | 0.005 g |
| 2-Methyl-5-chloro-4-isothiazolin-3-on | 0.01 g |
| 1-Hydroxyethyliden-1,1'-diphosphonic acid | 0.10 g |
| 2-Octyl-4-isothiazolin-3-on | 0.05 g |
| Bismuth chloride | 0.14 g |
| Polyvinyl pyrrolidone | 0.2 g |
| Nitrilotriacetic acid | 3 g |
| Magnessium chloride | 0.5 g |
| Ammonium hydroxide (28%) | 3 g |

made up to one liter with water and adjusted to pH 7.1 with acetic acid and potassium hydroxide.

An automatic processing machine was supplied in full with the above color developing solution, bleach-fixing solution and stabilizing solution, and running tests were made by processing the above color paper on which an image had been printed and by replenishing the above color developing solution, bleach-fixing solution and stabilizing solution in a predetermined amount at an interval of 3 minutes. The amounts replenished were 2.0 ml as for the color developing tank, 2.5 ml as for the bleach-fixing tank and 2.8 ml as for the stabilizing tank per 100 cm$^2$ of the color paper, respectively.

In the automatic processing device, the stabilizing tanks were arranged so that a first tank to a third tank were lined in the direction of flow of the light-sensitive materials, to employ the multiple tank countercurrent system in which replenishment of the solutions was made in the last tank first, the solution over flown from the last tank was introduced to its previous tank, the solution overflown from this tank was further introduced to its further previous tank and finally overflown from the most previous tank was employed.

The processing was continued until the total amount of the solutions replenished reached five times the total capacitites of the first to the third stabilizing tanks.

The sample after the continuous processings was taken out in a length of 1 m, stored under 80 % RH at 60° C. for 2 weeks and then wound up onto a role to measure stain concentration in the edge parts of the sample.

Further, unexposed portions and maximum density portions of the image parts were also stored under conditions of 80% RH and 60° C. for 2 weeks. Change in density after storage was compared with the initial density.

The results are shown in Table 2.

TABLE 2

| Experiment No. | Sample | Concentration at edge: Upon initiation of processing | Concentration at edge: Upon termination of running | Upon termination of running: Yellow stain concentration: initial concentration | Yellow stain concentration: after 4 weeks storage | Cyan dye concentration: initial concentration | Cyan dye concentration: after 4 weeks storage |
|---|---|---|---|---|---|---|---|
| Comparative 1 | *Comparative | 0.13 | 0.20 | 0.10 | 0.12 | 2.51 | 2.21 |
| Comparative 2 | *Present invention | 0.11 | 0.18 | 0.10 | 0.12 | 2.42 | 2.16 |
| Comparative 3 | **Comparative | 0.14 | 0.53 | 0.12 | 0.22 | 2.46 | 2.24 |
| Present invention 4 | **Present invention | 0.12 | 0.18 | 0.12 | 0.13 | 2.49 | 2.42 |

*Water washing processing;
**Stabilizing processing

As is apparent from Table 2, it is seen that the samples of the invention subjected to the stabilizing processing exhibits the most smallest edge contamination and shows preferable results in yellow stain and color fading.

EXAMPLE 6

An experiment was carried out following the same procedure as in Example 5 except that the bleaching agent in the bleach-fixing solution was replaced by the following:

| [Bleaching agent] | |
|---|---|
| (1) Diethylenetriaminepentaacetic acid iron (III) ammonium salt | 90 g/liter |
| (2) Cyclohexanediaminepentaacetic acid iron (III) ammonium salt | 80 g/liter |
| (3) Triethylenetetraminehexaacetic acid iron (III) ammonium salt | 90 g/liter |
| (4) 1,2-diaminopropanetetraacetic acid iron (III) ammonium salt | 80 g/liter |

As a result, the same results in Example 5 were obtained and the effects of the present invention were obtained.

EXAMPLE 7

Processing was carried out following the same procedure as in Example 5 except that the titanium oxide used for the substrate of the sample of the present invention was replaced by barium sulfate, the same results were obtained as in Example 5.

EXAMPLE 8

Processing with the bleach-fixing solution in Example 5 was replaced by individual processing with a bleaching solution and a fixing solution. Processing times were 1 minutes and 30 seconds, respectively. Processing temperature was 33° C. and Sakura Color CNK-4 type processing agent (produced by Konishiroku Photo Industries, Co., Ltd.) was used as a processing solution.

The same procedures as in Example 5 were followed except for the conditions described above.

The results obtained were substantially the same as in Example 5.

What is claimed is:

1. A method of processing a light-sensitive silver halide color photographic material which comprises subjecting to imagewise exposure, a light-sensitive silver halide color photographic material having a light-sensitive silver halide emulsion layer on one side of a substrate of an opaque thermoplastic resin film comprising a synthetic polyester film coated on its one side with at least one of (a) fine particles of white pigment and (b) a synthetic polyester film containing said fine particles of white pigment dispersed in the film and applied with molecular orientation, thereafter, color developing processing the photographic material including processing by use of a bleach fixing solution and, after processing by use of a bleach fixing solution, stabilizing processing the photographic material in a final stabilizing tank wherein the stabilizing processing is completed without substantially any water washing step by use of a stabilizing solution containing at least one of an organic phosphate and an aminocarboxylate, the concentration of silver complex ions in the final stabilizing tank being in the range of $2\times10^{-5}$ to $2\times10^{-1}$ mole/liter.

2. The method according to claim 1, wherein the bleach-fixing solution contains as a bleaching agent a ferric complex salt of organic acid.

3. The method according to claim 2, wherein the ferric complex salt of organic acid is diethylenetriamine pentaacetic acid iron (III) complex salt, cyclohexanediamine tetraacetic acid iron (III) complex salt or triethylenetetramine hexaacetic acid iron (III) complex salt.

4. The method according to claim 1, wherein a color developing processing is carried out immedeately before the processing by the bleach-fixing solution.

5. The method according to claim 1, wherein the bleach-fixing solution has the pH of 3 or more.

6. The method according to claim 1, wherein synthetic polyester film is present and the white pigment is an inorganic white pigment.

7. The method according to claim 1, wherein synthetic polyester film is present and the white pigment is contained in an amount ranging from 5 to 50 parts by weight based on 100 parts by weight of the synthetic polyester.

8. The method according to claim 6, wherein said inorganic white pigment is at least one selected from the group consisting of barium sulfate, titanium oxide, barium carbonate, talc, magnesium oxide and kaolin.

9. The method according to claim 6, wherein said inorganic white pigment is barium sulfate or titanium oxide.

10. The method according to claim 7, wherein said inorganic white pigment has a particle size ranging from 0.5 and 50 μm.

11. The method according to claim 9, wherein said inorganic pigment is titanium dioxide.

12. The method according to claim 2, wherein said ferric complex salt of organic acid has a molecular weight of at least 300.

13. The method according to claim 1, wherein said synthetic polyester resin is present and is a polyester acrylate having a molecular weight of about 1000.

14. The method according to claim 1, wherein said synthetic polyester resin is present and is polyethylene terephthalate.

15. The method of claim 1 wherein the stabilizing solution contains said organic phosphate which is selected from the group consisting of

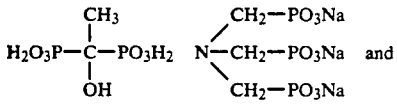

and

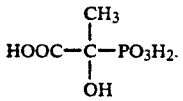

16. The method of claim 1 wherein the stabilizing solution contains a compound which is selected from the group consisting of

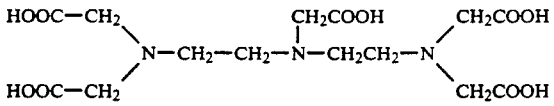

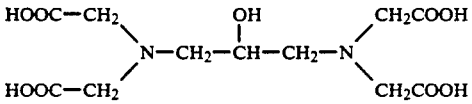

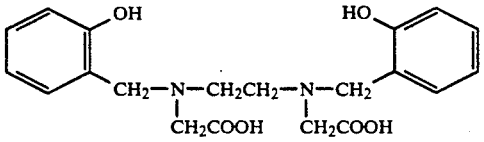

and

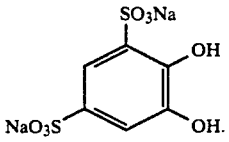

17. The method of claim 1, wherein the concentration of silver complex ions in the final stabilizing tank is in the range of $6\times10^{-5}$ to $1\times10^{-3}$ mole/l.

* * * * *